US006353671B1

(12) United States Patent
Kandel et al.

(10) Patent No.: US 6,353,671 B1
(45) Date of Patent: Mar. 5, 2002

(54) SIGNAL PROCESSING CIRCUIT AND METHOD FOR INCREASING SPEECH INTELLIGIBILITY

(75) Inventors: Gillray L. Kandel; Lee E. Ostrander, both of Troy, NY (US)

(73) Assignee: Bioinstco Corp., Troy, NY (US)

( * ) Notice: Subject to any disclaimer, the term of this patent is extended or adjusted under 35 U.S.C. 154(b) by 0 days.

(21) Appl. No.: 09/019,243

(22) Filed: Feb. 5, 1998

(51) Int. Cl.[7] ..... H04R 25/00

(52) U.S. Cl. ..... 381/318; 381/312; 381/313; 381/317; 381/320; 381/321; 704/209; 704/225; 704/234; 379/6

(58) Field of Search ..... 381/312, 317, 381/318, 320, 321, 81, 93, 313, 314, 104, 106, 107, 57, 316, 94.1, 94.3, 39, 58, 108, 109, 71.14, 102, 60, 71.1, 71.9; 404/209, 225, 234; 379/6

(56) References Cited

U.S. PATENT DOCUMENTS

| | | | | |
|---|---|---|---|---|
| 3,763,333 A | * | 10/1973 | Lichowsky | 179/107 R |
| 3,894,195 A | * | 7/1975 | Kryter | 179/107 |
| 3,967,067 A | | 6/1976 | Potter | 179/1.5 R |
| 4,051,331 A | | 9/1977 | Strong et al. | 179/107 R |
| 4,099,035 A | | 7/1978 | Yanick | 179/107 |
| 4,109,116 A | | 8/1978 | Victoreen | 179/107 E |
| 4,405,831 A | * | 9/1983 | Michelson | 179/1 P |
| 4,517,415 A | | 5/1985 | Laurence | 179/107 |
| 4,633,498 A | | 12/1986 | Warnke et al. | 381/23.1 |
| 4,731,850 A | | 3/1988 | Levitt et al. | 381/68.2 |
| 4,852,175 A | | 7/1989 | Kates | 381/68.4 |
| 4,879,749 A | | 11/1989 | Levitt et al. | 381/68.4 |
| 4,947,432 A | | 8/1990 | Topholm | 381/68.2 |

(List continued on next page.)

OTHER PUBLICATIONS

Maxwell, Joseph A. and Zurek, Patrick M., "Reducing Acoustic Feedback in Hearing Aids," IEEE Transactions on Speech and Audio Processing, vol. 3, No. 4, Jul. 1995, pp. 304–313.

Kahn, David, "Cryptology and the origins of spread spectrum," IEEE Spectrum, pp. 70–80, Sep. 1984.

Mueller, H. Gustav & Hawkins, David B., "Three Important Considerations in Hearing Aid Selection," Chapter 2, Handbook for Hearing Aid Amplification, vol. II, pp. 31–60, 1990.

Niemoeller, Arthur F., Sc.D., "Hearing Aids," Hearing and Deafness, Davis, Hallowell, M.D. & Silverman, S. Richard, Ph.D., 4th Ed., Holt, Rinehart and Winston, pp. 293–296.

Coren, Stanley, et al., "Sensation and Perception," 4th Ed., Harcourt Brace College Publishers, Fort Worth, Texas, pp. 421–424.

*Primary Examiner*—Curtis Kuntz
*Assistant Examiner*—Dionne N. Harvey
(74) *Attorney, Agent, or Firm*—Hoffman, Warnick & D'Alessandro LLC; Ronadl A. D'Alessandro

(57) ABSTRACT

A signal processing circuit and method for increasing speech intelligibility. The invention comprises a receiving circuit for receiving an audio signal detectable by a human. A gain amplifying circuit provides gain amplification of the audio signal. A shaping filter modifies the audio signal to be in phase with a second audio signal present at the receiving circuit and which is detected by the human unprocessed by the signal processing circuit. The shaping filter further differentially amplifies first and second speech formant frequencies to restore a normal loudness relationship between them. A feedback circuit controls the gain amplification in the gain amplifying circuit for enabling the signal processing circuit to substantially prevent regenerative oscillation of the amplified audio signal. Additionally, a signal tone may be injected into the signal processing circuit for automatically controlling the gain amplifying circuit.

24 Claims, 4 Drawing Sheets

U.S. PATENT DOCUMENTS

| | | | | | |
|---|---|---|---|---|---|
| 4,985,925 | A | | 1/1991 | Langberg et al. | 381/72 |
| 5,003,606 | A | | 3/1991 | Bordewijk | 381/68.4 |
| 5,033,090 | A | | 7/1991 | Weinrich | 381/68.4 |
| 5,271,397 | A | * | 12/1993 | Seligmann et al. | 607/137 |
| 5,285,502 | A | | 2/1994 | Walton et al. | 381/94 |
| 5,303,306 | A | | 4/1994 | Brillhart et al. | 381/68 |
| 5,343,532 | A | | 8/1994 | Shugart, III | 381/68.6 |
| 5,347,584 | A | | 9/1994 | Narisawa | 381/69.2 |
| 5,388,185 | A | * | 2/1995 | Terry | 381/320 |
| 5,420,930 | A | | 5/1995 | Shugart, III | 381/68.6 |
| 5,506,910 | A | * | 4/1996 | Miller | 381/103 |
| 5,594,387 | A | * | 1/1997 | Kagawa | 330/259 |
| 5,621,802 | A | * | 4/1997 | Harjani | 381/313 |
| 5,966,400 | A | * | 10/1999 | Den Braber | 375/75 |
| 6,128,369 | A | * | 10/2000 | Bowker | 379/29 |

* cited by examiner

SIGNAL PROCESSING CIRCUIT AND METHOD FOR INCREASING SPEECH INTELLIGIBILITY

FIELD OF THE INVENTION

The present invention relates generally to an electro-acoustic processing circuit for increasing speech intelligibility. More specifically, this invention relates to an audio device having signal processing capabilities for amplifying selected voice frequency bands without circuit instability and oscillation thereby increasing speech intelligibility of persons with a sensory neural hearing disorder.

BACKGROUND OF THE INVENTION

Persons with a sensory neural hearing disorder find the speech of others to be less intelligible in a variety of circumstances where those with normal hearing would find the same speech to be intelligible. Many persons with sensory neural hearing disorder find that they can satisfactorily increase the intelligibility of speech of others by cupping their auricle with their hand or using an ear trumpet directed into the external auditory canal.

Many patients with sensory neural hearing disorder have normal or near normal pure tone sensitivity to some of the speech frequencies below about 1000 Hz. These frequencies generally comprise the first speech formant. Associated with their sensory neural hearing disorder is many patient's diminished absolute sensitivity for the pure tone frequencies that are higher than the first speech formant. This reduced sensitivity generally signifies a loss of perception of the second speech formant that occupies the voice spectrum between about 1000 Hz and 2800 Hz. Not only is the patient's absolute sensitivity lost for the frequencies of the second formant but the normal loudness relationship between the frequencies of the first and second formants is altered, with those of the second formant being less loud at ordinary supra threshold speech levels of 40–60 phons. Thus when electro-acoustical hearing aids amplify both formants by an approximately equal amount at normal speech input levels, the loudness of the second formant relative to the first is lacking and voices sound unintelligible, muffled, and basso.

Patients with sensory neural hearing disorder often have difficulty following the spoken message of a given speaker in the presence of irrelevant speech or other sounds in the lower speech spectrum. They may hear constant or intermittent head sounds, tinnitus; they may have a reduced range of comfortable loudness, recruitment; they may hear a differently pitched sound from the same tone presented to each ear, diplacusis binuralis; or they may mishear what has been said to them.

It is well established that for those with normal hearing, the first and second speech formants which together occupy the audio frequency band of about 250 Hz to 2800 Hz, are both necessary and sufficient for satisfactory speech intelligibility of a spoken message. This is demonstrated in telephonic communication equipment, i.e. the EE8a field telephone, of WWII vintage, and by the development of the "vocoder" and its incorporation into voice encryption means of WWII (U.S. Pat. No. 3,967,067 to Potter and U.S. Pat. No. 3,967,066 to Mathes, as described by Kahn, IEEE Spectrum, September 1984, pp. 70–80).

The vocoding and encryption process analyzed the speech signal into a plurality of contiguous bands, each about 250–300 Hz wide. After rectification and digitization, and combination with a random digital code supplied for each band, the combined digitized signals were transmitted to a distant decoding and re-synthesizing system. This system first subtracted the random code using a recorded duplicate of the code. It then reconstituted the voice by separately modulating the output of each of the plurality of channels, that were supplied from a single "buzz" source, rich in the harmonics of a variable frequency fundamental centered on 60 Hz (if the voice were that of a male).

At no point in this voice transmission was any of the original (analogue) speech signal transmitted. The resynthesis of the speech signal was accomplished with a non-vocally produced fundamental frequency and its harmonics, that was used to produce voiced sounds. The unvoiced speech sounds were derived from an appropriately supplied "hiss" source, also modulated and used to produce the voice fricative sounds. Because of the limitations imposed by the number of channels and their widths, the synthesized voice contained information (frequencies) from the first and second reconstituted speech formants. Although sounding robot-like, to those with normal hearing, the reconstituted speech was entirely intelligible and because there was no transmitted analogue signal could be used with perfect security.

It is also important to note that the content of each of the plurality of bands that make up vocoder speech are derived from the same harmonic rich buzz source. Thus the harmonic matrix forms the basis of an intercorrelated system of voice sounds throughout the speech range which comprise the first and second formants. Intelligibility depends therefore, among other things, upon maintaining the integrity of the first and second speech formants in appropriate loudness relationship to one and the other. These relationships were preserved in the encrypted vocoding process and in the subsequent resynthesizing process.

The diminished capability to decipher the speech of others is the principle reason that sensory-neural patients seek hearing assistance. Prior to the development of electro-acoustical hearing aides, hearing assistance was obtained largely by an extension of the auricle either with a "louder please" gesture (ear cupping) or an ear trumpet. Both of these means are effective for many sensory-neural patients but have the disadvantage that they are highly conspicuous and not readily acceptable, as means of assistance, to the patients who can be aided by them. Modern electro-acoustical hearing aids, in contrast, are much less conspicuous but bring with them undesirable features, which make them objectionable to many patients.

The results of modern hearing aid speech signal processing differ greatly from the horn-like acoustical processing characteristics provided by either the passive device of an ear trumpet or a hand used for ear cupping. Especially for the frequencies of the second speech formant, the latter provide significant acoustic gain in the form of enhanced impedance matching between the air medium outside the ear and the outer ear canal. The passive devices moreover provide less gain for the first speech formant frequencies and do not create intrinsic extraneous hearing aid-generated sounds in the signals that are passed to the patient's eardrum. They also provide a signal absent of ringing and of oscillation or the tendency to oscillate at audible frequencies, which is usually at about 2900 Hz and called "howl" or "whistle" in the prior art. Moreover, passive devices, being intrinsically linear, in an amplitude sense, convey their signals without extraneous intermodulation products. As stable systems, passive devices have excellent transient response characteristics, are free of the tendency to ring, have stable acoustic gain, and have stable bandwidth characteristics.

An electro-acoustic hearing aid, in contrast, consists basically of a microphone, an earphone or loud speaker and an electronic amplifier between the two which are all connected together in one portable unit. Such electro-acoustical aids inevitably provide a short air path between the microphone and the earphone or loudspeaker, whether or not the two are housed in a single casing. If the unit is an in-the-ear type electro-acoustic hearing aid, there is almost inevitably provided a narrow vent channel or passageway through which the output of the earphone or loudspeaker may pass to the input microphone. This passageway provides a second pathway for the voice of the person speaking to the aid wearer whereby audio signals traveling in this passageway reaches the patient's auditory system (eardrum) unmodified by the aid.

Significant acoustic coupling between the microphone and the earphone render the entire electronic system marginally stable with the potential for regenerative feedback. Regenerative (or positive) feedback occurs when the instantaneous time variation in the amplitude of the output of the system is in-phase with the input signal. The gain of such a marginally stable system increases greatly while the passband of the system typically narrows in inverse proportion to the increase of the system's gain. When the loop gain exceeds unity the system will oscillate and if the oscillatory frequency is audible, and within the range of the patient's hearing capability, the resulting tone forms an objectionable sound, called a "howl" that tends to mask the speech signals coming from the hearing aid or through the passageway from without.

In U.S. Pat. No. 5,003,606 to Bordenwijk and U.S. Pat. No. 5,033,090 to Weinrich, an attempt is made to cancel the positive feedback by the use of the signal from a second microphone sensitive to sounds originating from sources near to the first microphone and then to feed the output of this second microphone into the signal amplifier in counterphase to the input from the first microphone. Although this means allows for some greater gain in a hearing aid so configured, it does not entirely eliminate marginal stability under all conditions, nor the howling, owing to positive feedback. The major drawback of these means is the inability of such systems to discriminate between a near signal generated by a signal source of interest and the signal deriving from the earphone. Bordenwijk finds it necessary to introduce the inconvenience of a separate control to adapt the aid for listening to nearby signals of interest. One disadvantage of Weinrich's in-the-ear system, which locates the near microphone in the vent tube, is that the diameter of this tube is generally narrow. Such narrowing may limit the amplitude of the signals that are fed in counterphase to the amplifier. If narrow enough, this negatively affects the quality of the sound heard by the patient directly through the vent.

U.S. Pat. No. 5,347,584 to Narisawa attempts to eliminate acoustical regeneration by a tight fitting means that effectively seals the in-the-ear earphone earmold of the hearing aid to the walls of the outer ear canal near the tympanic membrane. However, this means poses a potential threat to the integrity of the tympanic membrane itself from changes in the external barometric pressure and establishes an unhygienic condition owing to lack of air circulation in the enclosed space if worn for an extended period. For some wearers the unremitting pressure on the internal surfaces of the external ear canal may also predispose to the development of itching, excessive ceruminocumulation and pressure sores. Moreover this approach to the elimination of positive feedback makes the wearer completely at the mercy of the hearing aid for the detection of any external sounds and makes the heard sound unnatural. Thus, if either the hearing aid or its power supply fails, that ear of the wearer is completely cut off from the outside audible world making the patient's residual hearing useless no matter how much of it there remains for that ear. Further, although this system blocks all air conducting positive feedback sounds, the possibility of positive feedback through the casing of the hearing instrument itself and through the tissues of the head, remain problematic at higher gains.

Critical information for the person with normal hearing is contained in the bands of the first and second formants and there is thought to be especially critical information in specific regions of the latter, namely the higher frequencies of the first formant and the lower frequencies of the second formant. These contain the frequencies which comprises the voiced consonant sounds (named formant transitions in voice spectrography).

In U.S. Pat. No. 4,051,331 to Strong and Palmer it is proposed to "move" this information by transposition into the region of the voice spectrum where some severely hearing impaired sensory-neural patients have spared sensitivity. For example, if for a given speaker the voiced, unvoiced and mixed speech sounds are centered about a frequency f(t), the speech signal processor of a Strong et al. hearing aid transposes this information such that it will be centered about F(o) where F(o)<f(t) and lies within first formant range where the sparing resides. This system is proposed and may be useful for the most profoundly impaired sensory-neural patient. Such recentering does not provide a natural sounding voice and leaves such patients much more at risk for the degradation of intelligibility that occurs from the masking of other voice sounds by extraneous noises. These are usually the lower frequencies found in the first speech formant. The majority of patients with lesser sensory neural hearing deficits do not require such a system as taught by Strong et al. For them, speech intelligibility can be dealt with satisfactorily with the limited gain offered by ear cupping or an ear trumpet, thereby sustaining no loss from masking effects and no loss of voice fidelity. Thus, the Strong et al. invention offers no advantage to these patients and provides some disadvantages.

It is a common observation that patients with sensory neural hearing deficits are hampered by their inability to extract intelligible speech in a so-called noisy environment due to the effect that lower speech frequencies mask the higher frequencies of the second formant such as those required for speech intelligibility. This disability from ambient noise occurs in those with normal hearing as well but not to the extent experienced by persons with sensory neural hearing deficits. The so-called noise may be of a vocal or non vocal origin but is usually composed of sounds within the spectral range of the first formant. Prior art to deal with this problem includes, for example, directional hearing aid microphones and binaurally fitted hearing aids (See Mueller and Hawkins, Handbook for Hearing Aid *Amplification*, Chapter 2, Vol. II, 1990).

U.S. Pat. No. 5,285,502 to Walton et al. attempts to deal with the noise and compensation problems concurrently by dividing the speech signal with a variable high and a low pass filter. This approach varies the attenuation of the lower frequencies of the first voice formant by moving the cutoff slope characteristic of the high pass filter to higher or lower frequencies. When the noise level is low, the cutoff moves toward the lower frequencies permitting whole voice spectrum listening because the system passes more of the lower frequencies of the first formant. As the noise level builds, a level detector output shifts the low frequency slope of the variable high pass filter toward higher frequencies. As this occurs the overall gain of the system for the first formant frequencies that contains the noise declines. However, the lower end of the highpass filter response characteristic remains below the formant transition zone so that this important region that contains the information from which differential consonant and vowel sounds emerge, is always conveyed to the patient. In this way, Walton only attenuates the lower frequencies and maintains the higher frequencies (i.e. the second speech formant frequencies) at a constant amplification.

U.S. Pat. No. 5,303,306 to Brillhart et al. teaches a programmable system that switches from one combination of bandpass, gain, and roll off conditions to another as the wearer selects desired preprogrammed characteristics. This patent teaches a dual band system that has a plurality of programmed or programmable acoustical characteristic that conform to the patient's respective audiogram, loudness discomfort level and most comfortable loudness level. These devices are generally complex, and inconvenient to use because they must be programmed with a separate remote controller unit which must be directed to the ear unit. Furthermore, they are expensive and do not eliminate regeneration and all its attendant problems brought on by marginal stability. Additionally, they may not have a manually operated on and off switch that users find most congenial and convenient. Most importantly they do not perform as well as an ear trumpet and do not permit a patient to hear under demanding circumstances as when a podium speaker is to be heard from the rear of a noisy auditorium.

Ear cupping and the ear trumpet on the other hand, by restoring the acoustical balance between the first and second formants with a system that does not regenerate, deal with the detrimental effects of noise on speech intelligibility in an entirely different and more efficient manner. These passive devices provide differential gains for the first and second speech formant frequencies. The electro-acoustical devices and methods of the prior art are each subject to its own drawback. The devices and methods either have marginal stability and are subject to changing gain, howl (regeneration) and uncertain band width or they fail to make best use of the patient's residual hearing thus failing to restore both intelligibility and to preserve the patient's ability to retrieve speech in a noisy environment.

These and other types of devices and methods disclosed in the prior art do not offer the flexibility and inventive features of our signal processing circuit and method for increasing speech intelligibility. As will be described in greater detail hereinafter, the circuit and method of the present invention differ from those previously proposed. For example, the present invention actively monitors the acoustic environment in which it operates.

SUMMARY OF THE INVENTION

According to the present invention we have provided a signal processing circuit for increasing speech intelligibility comprising a receiving circuit for receiving an audio signal detectable by a human. A gain amplifying circuit generally amplifies the gain of the audio signal. A shaping filter modifies the audio signal wherein the modified audio signal is made to be in phase with a second audio signal present at the receiving circuit and which is detected by the human unprocessed by the signal processing circuit. Further, the shaping filter also differentially amplifies first and second speech formant frequencies of the audio signal as a function dependent on a frequency of the audio signal. A feedback circuit is provided for controlling the gain amplification in said gain amplifying circuit and wherein the signal processing circuit substantially prevents regenerative oscillation of the amplified audio signal.

A feature of the invention relates to a method of processing an audio signal for increasing speech intelligibility to a human. One embodiment of our method comprises the steps of receiving an audio signal; modifying the audio signal to be in phase with a second audio signal present at the receiving circuit and which is detectable by the human and unprocessed by the signal processing circuit; amplifying frequencies of the audio signal differentially wherein substantially only second speech formant frequencies of said audio signal have varied amplified gain; and controlling the gain amplification wherein the signal processing circuit substantially prevents regenerative oscillation of the amplified audio signal.

Still another feature of the invention concerns a signal injection circuit for injecting a signal tone to mix with said audio signal and wherein the feedback circuit further comprises a gain control circuit for automatically controlling the gain amplifying circuit as a function of the sensed level of the injected signal tone.

According to important features of the invention we have also provided the feedback circuit further comprising a processing filter for providing a negative feedback to the gain amplifying circuit as a function of change in environmental variables.

In accordance with the following, it is an advantage of the present invention to provide a signal processing circuit that reduces regenerative feedback, that emulates the acoustical characteristics of ear cupping or an ear trumpet and that has usable gain characteristics superior to these passive devices.

A further advantage is to provide a processing circuit that provides a wearer the capability to adjust the amplification of the overall gain as well as specific differential amplification of first and second speech formants in relation to a specific roll-off frequency.

Yet a further advantage is to provide a portable electro-acoustic hearing aid for sensory neural patients, wherein the aid has one or more of the above signal processing circuit characteristic advantages.

Another advantage is to provide an electroacoustic hearing aid that responds to the limitation that amplification of the higher frequency sounds (second formant) is marginal at best in conventional hearing aids and that the desired amount of amplification is often the maximum allowable, subject to the constraint that regenerative howling not occur.

Still another advantage is to provide an electro-acoustic hearing aid that contains a vent or passageway to permit an unprocessed and processed signal to be in phase with one and the other throughout the spectral limits of the first and second formants once they reach the tympanic membrane (eardrum) of a hearing aid wearer.

DESCRIPTION OF THE DRAWINGS

Other features and advantages of our invention will become more readily apparent upon reference to the following description when taken in conjunction with the accompanying drawings, which drawings illustrate several embodiments of our invention.

DETAILED DESCRIPTION OF THE PREFERRED EMBODIMENT

Figure 1:
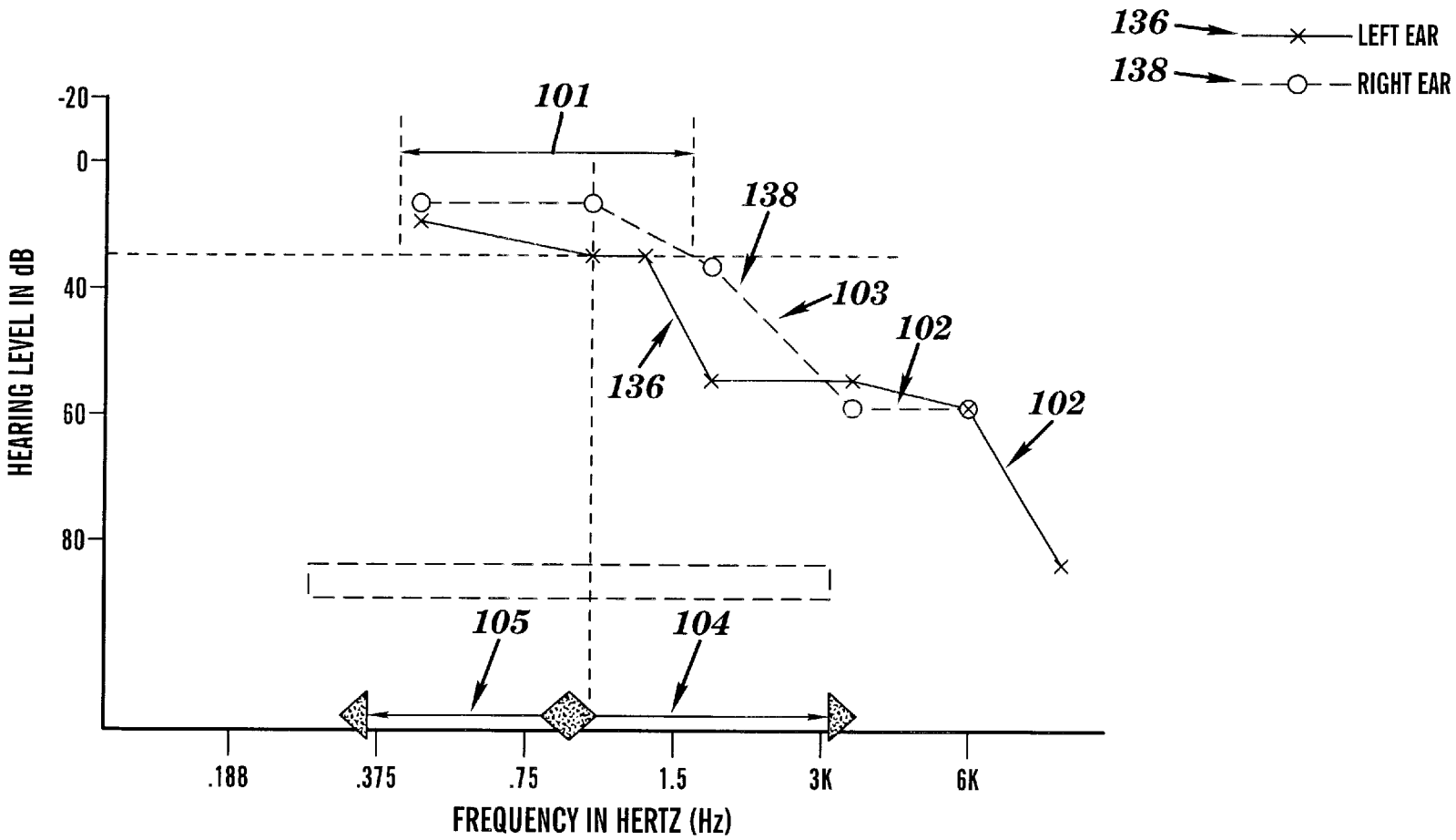
FIG. 1 is a bilateral audiogram of a patient with sensory neural hearing disorder.

Referring generally to the drawings, and specifically to FIG. 1, the zone of spared pure tone hearing, 101, of a patient with sensory neural hearing deficit is shown. This patient has relatively normal hearing for the first speech formant i.e. up to about 1.0 KHz. This patient is considered to have a moderate deficit. He has continuous tinnitus.

The general extent of the first 105, and second 104, speech formants are shown on the abscissa of this graph. Curve 136 designates hearing in the left ear and curve 138 designates hearing in the right ear. The patient's hearing for pure tones is virtually nil for frequencies higher than 3000 Hz, zone 102, yet the patient's capacity to decipher speech is significantly enhanced by ear cupping despite the patient's decreased sensitivity to the frequencies between 1 KHz and 3 KHz, part 103 of 138, which constitutes the second speech formant range, 104.

Figure 3:
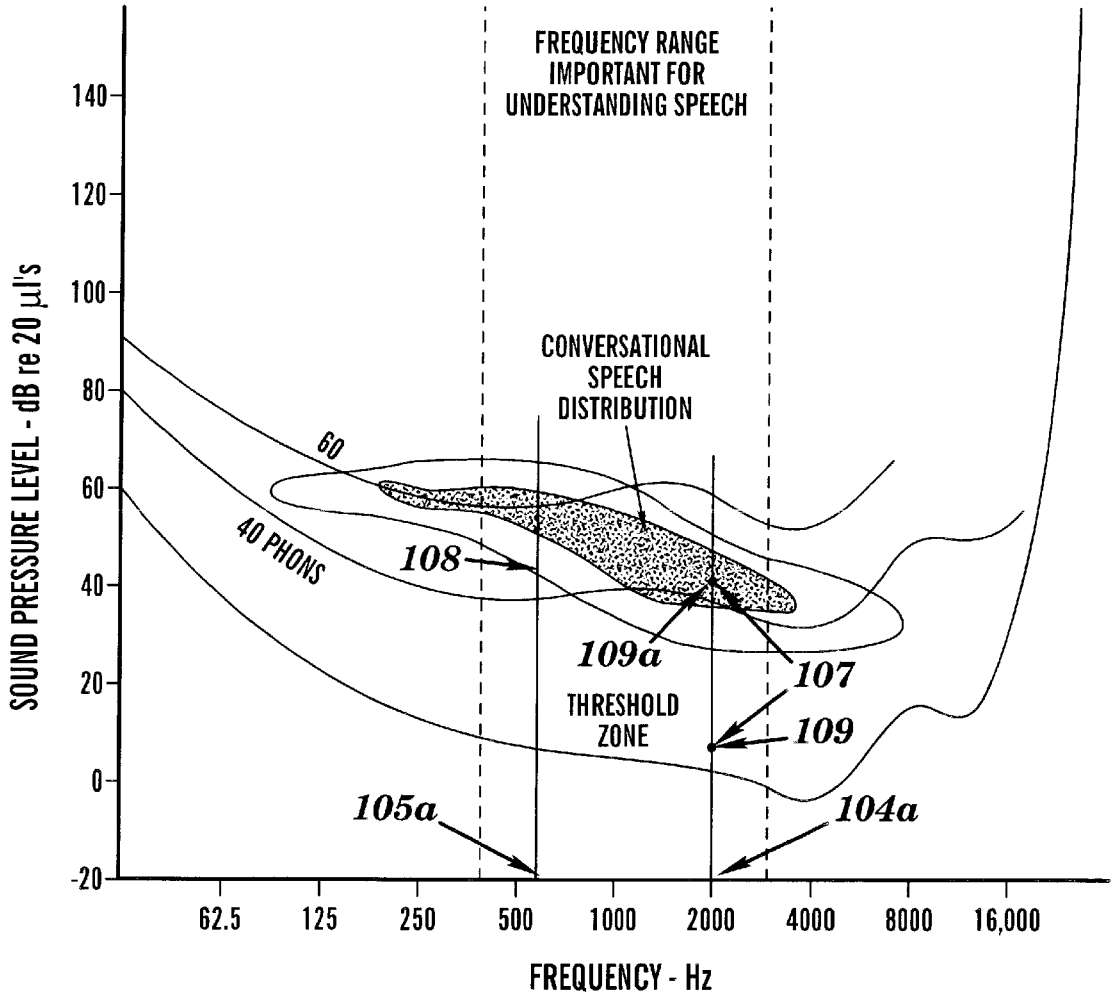
FIG. 3 is a graph of the approximate distribution of sound-pressure levels with respect to frequency that would occur if brief but characteristic bits of phonemes of conversational speech were actually sustained as pure tones.

Speech is a mixture of complex tones, wide band noises and transients with both the intensity and frequency of these changing continually. It is thus difficult to measure these and logically impossible to plot them precisely in terms of sound pressure levels at particular frequencies. Nevertheless, FIG. 3 seeks to illustrate the fact that speech communication usually occurs at the 40–60 phon level, the phon being a unit of loudness where zero phons is at the threshold for a particular frequency and 10, 20, and 30 etc. phons represent tones at 10, 20 and 30 dB respectively above the normal threshold for a particular tone. The darker irregular oblong within the larger irregular oblong of FIG. 3 is the speech "area." Since individual voices differ, the boundaries of the speech "area" extend away from the central zone which represents the greater probability of finding, in a sample of speech, the combinations of intensity and frequency depicted. The surrounding zone represents a lesser probability of occurrence.

At 105*a* of FIG. 3 there is generally represented a centroid frequency of the first speech formant; at 104*a* there is generally represented a centroid frequency of the second speech formant. As shown here, zero phons for a person with normal hearing is a threshold value varying between 60 dB (i.e. 20 $\mu$Pa) for near 0 Hz tones to zero dB for approximately 3000 Hz tones. For example, the sensory neural patient's (depicted in FIG. 1) loudness level for the first speech formant will generally be in the 40 to 50 phons level zone (650 Hz). At ordinary speech levels this is point 108 on the graph, which corresponds to that loudness level of first speech formant frequencies at typical speech (conversation) levels.

However, since the thresholds for the higher frequencies, e.g. 2000 Hz, are elevated for this patient, the loudness level for them will be zero to 10 phons, since the patient's loudness is then at point 109 of the graph, which corresponds to the loudness level of the second speech formant at typical speech levels for this sensory neural patient. In such a case this loudness level equates to a whisper and thus there is a diminished perception for the frequencies of the second speech formant.

As disclosed and claimed by our invention, differential amplification of the second formant equalizes the loudness relationship between the first and second formants and provides better definition of the formant transitions. That is, by amplifying the second speech formant frequencies of a speech signal, point 109 in this example, to a greater degree than that of the first speech formant, the loudness of the second formant is perceived at a level more nearly equal to the first formant, e.g., points 109*a* and 108. The distance at 107 represents the hypothetical gain in loudness afforded by the differential amplification of the second formant as taught by our invention. Accordingly, amplitude boosting of the second speech formant compensates for the sensory neural patient's decreased perception of second speech formant frequencies and provides the patient with a signal processing circuit that delivers a more "normal" loudness relationship between the first and second speech formants (as "normal" would be perceived by one without a sensory neural disorder). It is this compensation which greatly enhances intelligibility for speech signals processed by our invention.

Figure 2:
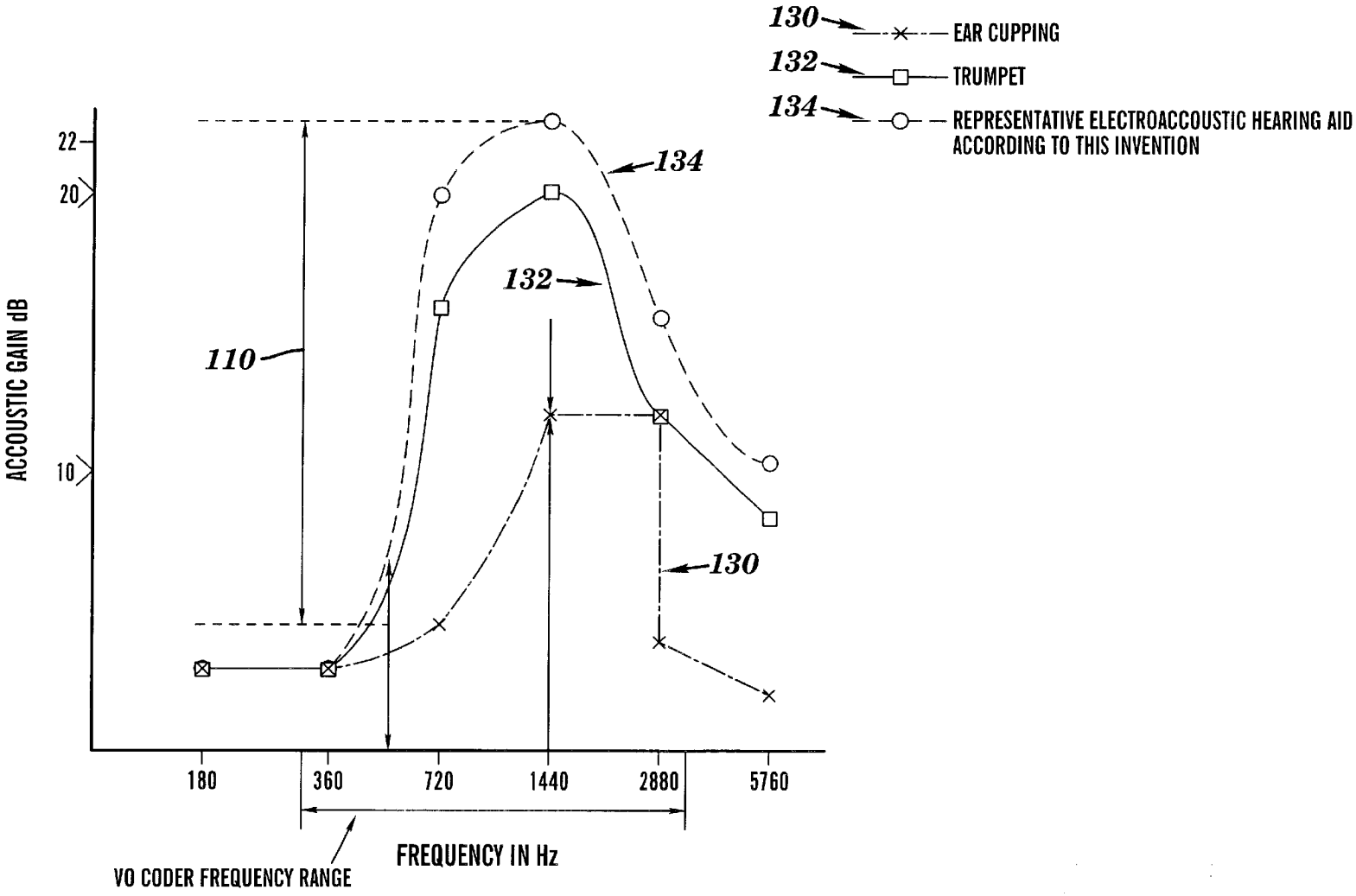
FIG. 2 is a graph of relative acoustic gains of ear cupping, of ear trumpets and the present signal processing circuit invention designed to emulate the acoustic properties of the electrically passive devices, where the appropriate extent of a multichannel vocoding analysis used to transmit intelligible speech in WWII voice encryption devices is shown on the abscissa.

With reference to FIG. 2, the relative acoustic gains provided for the first and second speech formants, by passive ear cupping curve 130, or an ear trumpet curve 132, bring about sufficient normalization of the two speech formants to restore the loudness relationship necessary to provide improved speech intelligibility for the patient with the audiograms depicted in FIG. 1. The results obtainable by the present invention, however, represented by curve 134 permit an even greater useable gain of the second speech formant because regenerative feedback, as discussed in detail hereafter, is substantially controlled and thus loudness compensation for the second formant can be supplied so as to exceed the acoustic gain provided by the passive devices of ear cupping or an ear trumpet. The present invention can therefore equalize the loudness of the first and second speech formant frequencies in patients with sensory neural deficits that exceed those shown by the patient in FIG. 1.

Figure 4:
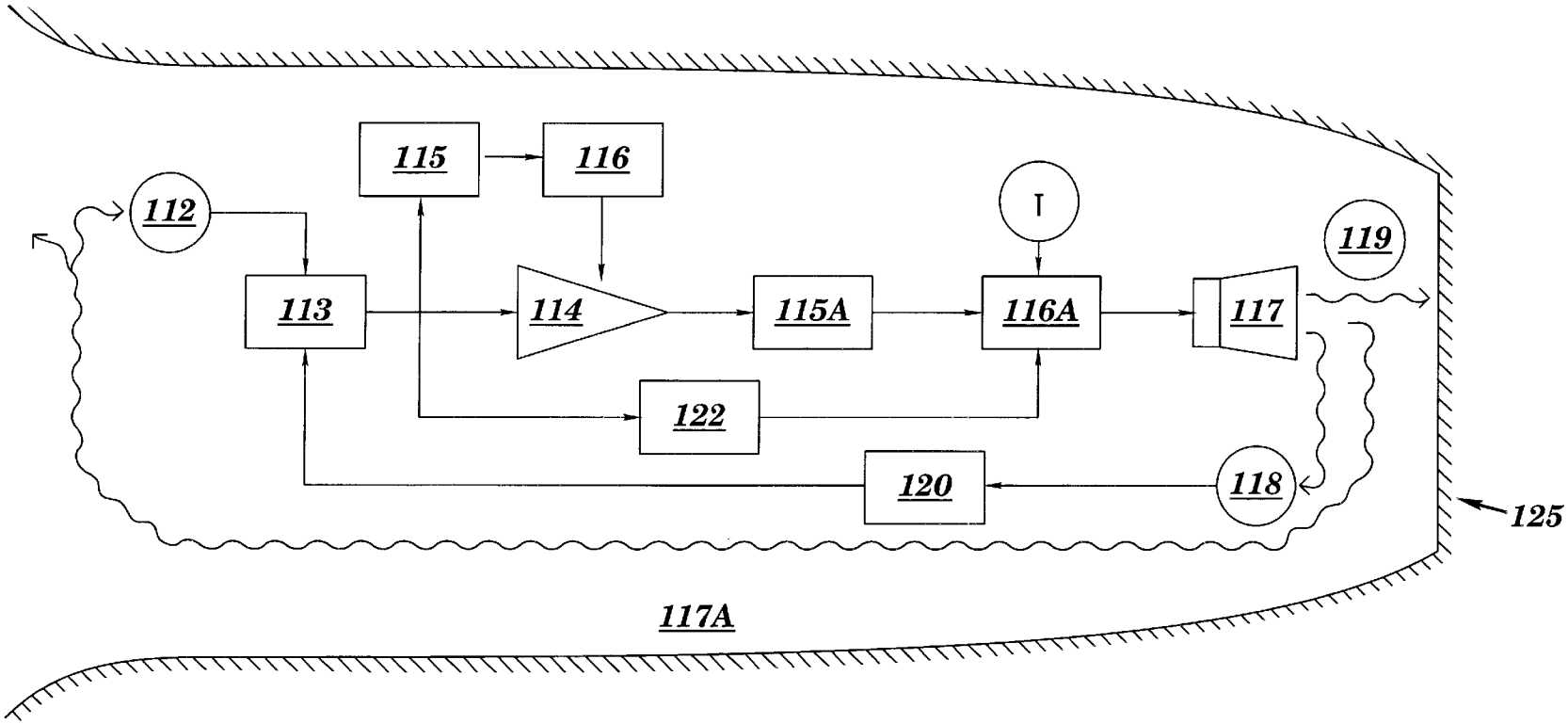
FIG. 4 is a block diagram of a preferred embodiment of our signal processing circuit in accordance with the features and advantages of our invention.

FIG. 4 depicts a schematic of a preferred embodiment of a signal processing circuit according to the features and advantages of this invention. The invention provides the acoustic characteristics of passive devices depicted in FIG. 2 but is able to provide even greater gain, through differential gain amplification as depicted by 110. Various applications exist for this invention, such as a signal processing circuit for use in a public address system or in a hearing aid.

In a preferred application of this embodiment the signal processing circuit comprises an electro-acoustic hearing aid wherein the sounds in the air space surrounding the earphone/loudspeaker and microphone are incorporated into the signal processing function of the system. This is accomplished with sensor, feedback and feedforward circuity which monitor the sounds in the air space surrounding the hearing aid as well as a specifically injected tone T described more fully hereinafter. It should be understood that because certain components are environment dependent, specific circuit equation values will differ from application to application. Accordingly, the application of our signal processing circuit for a hearing aid serves as an example for practicing our invention. Our invention is not limited by the particular environmental factors considered herein.

Returning to FIG. 4, an example of our circuit as applied to an electro-acoustic hearing aid is depicted. This comprises a main microphone 112 that feeds an audio signal into an additive mixer 113. The mixer is not a required separate circuit component but merely is depicted here separately to more clearly define the operation of this component of the embodiment of our signal processing circuit. Next, output is fed into a gain amplifier 114 which amplifies second formant frequencies passing therethrough (except a signal tone T as defined hereafter) and preferably does not pass first formant frequencies. The magnitude of gain amplification may be preset dependent on a human user's diagnosed hearing disorder or desired levels, it may be manually adjustable or preferably it will be automatically adjustable as discussed hereinafter. The gain amplifier 122 amplifies first formant frequencies, is also adjustable in gain, and preferably does not pass second formant frequencies or tone T.

The output from 114 in turn is fed into a shaping filter 115A. The output of filter 115A is fed into a mixer 116A where it is combined with the output of amplifier 122 and with a local injected signal tone T, whose frequency is approximately 6000 Hz in this embodiment. Again, the mixer 116*a* is not a required separate circuit component but merely is depicted here separately to more clearly define the operation of this embodiment of our signal processing circuit.

The output of mixer 116A is transmitted by the earphone or loudspeaker 117 as air mechanical vibrations into an ear cavity 119. The earphone or loudspeaker 117 is optimized for efficient power transfer of mechanical vibrations to the eardrum and is coupled to the ear cavity. Also, preferably the earphone or loudspeaker may feed, in the case of electro-acoustic hearing aids that are placed in the external auditory canal, into a passageway of the aid so as to have its output merge with the signal coming from the external source. This arrangement allows for phase coherence between the signal processed by the hearing aid and the signal from the outside. The vent's internal diameter may be as large as convenient since it is unnecessary to limit the response characteristics of this path to prevent positive acoustic feedback. The naturalness of the speech as heard by the patient may thus rely heavily on the patient's residual hearing and the resistance of the aid's processing system not to oscillate.

Airpath 117A carries the air vibrations produced by the earphone or loudspeaker to the exterior microphone sensor 112 and to a second interior sensor 118. The second sensor 118 is sensitive to the air vibrations of its environment occasioned by the earphone or loudspeaker 117 output, vibrations of the eardrum in the ear cavity 119 in response to the earphone's output, and to any oto-acoustic emission that derives from the ear itself.

Excellent results are obtain when our signal processing circuit includes the sensor 118 and a processing filter 120 which transmit a feedback, and preferably a negative feedback, signal from the ear cavity to the amplifier 114 via the mixer 113. In this way, these components provide a way of stabilizing the signal processing circuit and preventing regenerative oscillation of processed amplified audio signals.

Yet another preferred feature that our invention may include is phase filtering, as depicted in FIG. 4, which takes place in the shaping filter 115A. In this regard, 115A is designed so that direct air borne sound reaching the eardrum of the hearing aid wearer is in phase with the output of a processed audio signal from the earphone 117. The same phase filtering occurs in 122 for the first formant frequencies.

Gain amplifier 114 is also preferred to comprise a circuit which may include amplitude filtering for differentially processing the second formant frequencies, as discussed above. In application, the magnitude of amplification is a function of the decibel gain necessary to restore the loudness relationship between the first and second formants, as shown in FIG. 3, and dependent on at least the frequency of the audio signal being amplified, as seen in FIG. 2. Excellent results are also contemplated if the differential gain curve, FIG. 2, and the magnitude of gain amplification, FIG. 3, are patient dependent to fit each person's particular needs. As discussed above, the patient dependence may be adjustable or fixed.

In this preferred embodiment of our invention, the signal tone T is injected into the circuit at mixer 116A to be mixed with the audio signal. The transmission of the signal tone T to the output of the mixer 113 occurs through feedback via 117, 118, 120, 117A and 112. This signal tone T is extracted by a narrow band filter 115 and fed forward through an amplitude demodulator 116, which is also a low pass filter. The output of the demodulator 116 determines the gain of the amplifier 114. The overall airpath sounds and device feedback thereby control the gain of the amplifier 114. The amplifier 114 preferably passes all second formant frequencies but does not pass signal T. Amplifier 122 does not pass signal T either, so that signal T may be processed as an open loop signal in this particular embodiment.

For example, as the feedback increases, leading to potential increased signal processing circuit regenerative gain of processed audio signals and thus instability, the feedforward gain amplification at 114 decreases. The magnitude of decrease is a function of the level of tone T at sensors 112 and 118. Preferably, this gain control is automatic and comprises complementary circuity in components 116 and 114. With this additional preferred circuitry, feedback that often leads to regenerative oscillation can be further controlled and the circuit stabilized beyond that possible with just feedback circuit components 112, 113, 118 and 120. The patient can also adjust the aid with reduced likelihood of encountering oscillation.

The feedback role of signal T could be unintentionally defeated in this embodiment by an external sound source of 6000 Hz. This is seen as a minor inconvenience in exchange for the feedback control provided by signal T. However, to minimize such a problem the filter 115 is preferably selected as narrow band. Further, to produce stability of the filter 115's center frequency relative to the frequency of T, the filter 115 may be implemented by a phase lock to the source signal tone T. Alternatively, another way to minimize sensitivity to an external source at 6000 Hz could be to reduce sensitivity of the external sensor 112 to 6000 Hz. Yet alternatively, minimizing sensitivity to an external source at 6000 Hz could be done by modulating the injected signal T using pulse or frequency modulation and then adding processing to the demodulator 116 so as to decode and detect only the modulation of the injected signal T. Yet alternatively again, 115 may be implemented to pass some of the second formant frequencies so that an exaggerated second formant will reduce second formant gain of 114. A second means for controlling for variation in environmental variables is to employ sensor 118 in combination with feedback of the second speech formant.

Following are system equations for implementing our invention shown in FIG. 4 and described hereinabove. H(i)(S)=H(i)=transfer function for component i, and V(i)(S)=V(i)=output for component i. These system equations apply at the frequencies of the second formant and tone T.

First, V(112)=$H_A$V(116A) and V(118)=$H_B$V(116A), where $H_A$, $H_b$ depend on loudspeaker or earphone 117, air path 117A and microphones/sensors (112, 118 respectively). Tissue mechanics, including eardrum movement, also affect $H_A$, $H_B$. Further, $H_A$ represents the feedback that is always present between any earphone loudspeaker and microphone, as known in the art.

Then, V(113)=V(112)+H(120)V(118).

Next, V(114)=−K(116)V(113), and H(114)=−K(116), where K(116) is the gain of 114 controlled by 116.

Now, V(115)=H(115)V(113) where H(115) is defined by 115 comprising a narrow band filter that passes signal tone T.

Then, V(115A)=H(115A)V(114), where H(115A) is defined, for example, as a differential increase in decibels of the audio signal dependent on the frequency thereof as seen in FIG. 2. Additionally, excellent results are contemplated when the differential amplification is also dependent on the user, since each user may have slightly different requirements. In this way, the relative gain of the second speech formant as compared to the first speech formant can be adjusted. Also, it should be understood that the shaping filter 115A is subject to requirements for "physical realizability" of H(115A).

Next, V(116A)=V(115A)+V(122)+T, where signal tone T has a fundamental frequency at approximately 6000 Hz. For the second formant frequencies and tone T, the output V(122)=0, since 122 passed only the first formant frequencies.

Then, V(117)=H(117)[(T−H(115A)K(116)V(112))/(1+(H(115A)K(116)(H(120)$H_B$+$H_A$))], where H(117)is the characteristic of the loudspeaker and depends upon the choice of speaker. Also, it is understood that the output V(117) is the acoustic pressure generated by the earphone or loudspeaker. For example, in application when signal T does not appear at V(115), then V(116)=0, K(116)=1, and the hearing aid processing circuit has full gain. The proceeding equation becomes V(117)=−H(117)[H(115A)V(112)/(1+H(115A)(H(120)$H_B$+$H_A$))]. As signal T appears at V(115) and increases then V(116) increases dropping K(116) and reducing the gain of 114.

Next, H(120) is chosen to approximate $-H_A/H_B$; that is, H(120)$H_B$+$H_A$ is approximately=0. By matching H(120) to $H_A$ and $H_B$ in this manner one has V(117)≈−H(117)H(115A)V(112) at full gain (i.e., K(116)=1), in which case, the hearing aid output becomes approximately independent of acoustic environment functions $H_A$ and $H_B$. In summary, H(120) comprises the control circuit where the gain of H(120)=0 for first formant frequencies, H(120)$H_B$+$H_A$ approximate zero for the second formant frequencies and the gain and phase shift of H(120), at the frequency of the tone T, are selected to reduce the occurrence of oscillation.

Then, V(116)=V(115)*T and K(116)=1−V(116), where * indicates demodulation and where the equation for 116 is one of a variety of functional embodiments in which V(116) increases as signal T appears at V(115) causing a reduction or a constant value for K(116). The demodulator 116 is preferably designed such that K(116) falls between 0 and 1, for convenience. Further, it is preferred that the maximum frequency for K(116) be lower than a phonemic rate, specially below 90 Hz.

Still a further design feature comprises fixing the amplification of first formant frequencies with bandpass filter 122 that amplifies first formant frequencies only. This design is dependent on component 120 such that H(120) is constrained to have no amplification at the first formant frequencies and the earphone or loudspeaker output at low frequencies remains at V(117)=H(122)V(112), even as feedback occurs to modify amplification at the second formant frequencies.

Yet in another design alternative, one can choose frequency tone T below the patient's low frequency hearing limit and above the maximum of K(116) instead of approximately 6000 Hz.

As various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

We claim:

1. A method of processing an audio signal in a hearing aid for increasing speech intelligibility to a human comprising the steps of:

receiving an audio signal;

differentially amplifying a first frequency range that substantially comprises first speech formant frequencies and a second frequency range that substantially comprises second formant frequencies of said audio signal;

mixing an injected inaudible signal tone with said audio signal;

sensing a level of presence of the signal tone; and automatically controlling gain amplification of only the second frequency range based on the sensed level of the injected signal tone, wherein regenerative oscillation of the audio signal is substantially prevented.

2. The method of claim 1 in which said step of amplifying comprises:

amplifying substantially only second speech formant frequencies of said audio signal to normalize a loudness relationship between said second speech formant frequencies and first speech formant frequencies.

3. The method of claim 1 further including modifying said audio signal wherein said modified audio signal is in phase with a second audio signal present at the receiving circuit and which is detectable by the human and unprocessed by the signal processing circuit.

4. The method of claim 1 wherein the step of automatically controlling comprises:

sensing an amplified audio signal; and processing said amplified audio signal to provide a negative feedback only to the second frequency range for substantially preventing regenerative oscillation of said amplified audio signal.

5. A method of processing an audio signal in a hearing aid for increasing speech intelligibility to a human comprising the steps of:

receiving an audio signal;

passing the audio signal through a signal processing circuit having an output, and outputting a modified audio signal from the output;

phase aligning the modified audio signal with an unpassed audio signal present at the output;

amplifying frequencies of said audio signal differentially wherein a second frequency range comprising second speech formant frequencies of said audio signal has an amplified gain greater than a gain amplification of a first frequency range comprising first speech formant frequencies, regardless of a presence of noise in the first and second frequency ranges; and controlling said amplified gain based on an inaudible signal tone, wherein the signal processing circuit substantially prevents regenerative oscillation of said amplified audio signal.

6. The method of claim 5 in which said step of amplifying comprises:

amplifying only said second frequency range of said audio signal to normalize a loudness relationship between said second speech formant frequencies and first speech formant frequencies.

7. The method of claim 5, wherein the step of phase aligning comprises:

providing first and second filters for phase aligning first and second speech formant frequencies with the unpassed audio signal present at the output.

8. The method of claim 7 further including a step of mixing a signal tone with said audio signal and wherein said step of controlling comprises sensing a level of presence of the signal tone and automatically controlling said gain amplification based on the sensed level of the signal tone.

9. The method of claim 5 wherein the step of controlling comprises:

sensing an amplified audio signal; and processing said amplified audio signal to provide a negative feedback for substantially preventing regenerative oscillation of said amplified audio signal.

10. The method of claim 9, further including the steps of:

mixing a signal tone with said audio signal;

sensing a level of presence of the signal tone; and controlling automatically said gain amplification based on the sensed level of the signal tone.

11. A hearing aid signal processing circuit for increasing speech intelligibility to a human, said human having at least one eardrum, comprising:

a receiving circuit for receiving an audio signal;

a gain amplifying circuit for differentially amplifying a first frequency range comprising first speech formant frequencies and a second frequency range comprising second speech formant frequencies of said audio signal as a function of the difference in decibels for restoring a sound pressure level of said second frequency range to a normal level dependent on said human and a frequency of said audio signal; and a feedback circuit for controlling gain amplification of only one of the frequency ranges based on a sensed level of an inaudible continuous signal tone, wherein the signal processing circuit substantially prevents regenerative oscillation of the audio signal.

12. The signal processing circuit of claim 11, wherein said feedback circuit comprises a processing filter for providing a negative feedback to change gain amplification by the gain amplifying circuit as a function of sensed environmental variables.

13. The signal processing circuit of claim 12, further comprising a signal injection circuit for injecting a signal tone to mix with said audio signal.

14. The signal processing circuit of claim 13, wherein said feedback circuit comprises a gain control circuit for automatically controlling the gain amplifying circuit as a function of the presence of the signal tone.

15. The signal processing circuit of claim 11, wherein said gain amplifying circuit is manually controlled for variable gain amplification.

16. The signal processing circuit of claim 11, wherein said feedback circuit further comprises a gain control circuit for automatically controlling the gain amplifying circuit.

17. The signal processing circuit of claim 11, wherein the gain amplifying circuit comprises a first gain amplifier that amplifies only said first frequency range and a second gain amplifier that amplifies only said second frequency range.

18. The signal processing circuit of claim 11, further comprising a signal injection circuit for injecting a signal tone to mix with said audio signal.

19. The signal processing circuit of claim 18, wherein said feedback circuit comprises a gain control circuit for automatically controlling the gain amplifying circuit as a function of the sensed level of the signal tone.

20. The signal processing circuit of claim 19, wherein said feedback circuit further comprises a processing filter for providing a negative feedback to change gain amplification by the gain amplifying circuit as a function of sensed environmental variables.

21. The signal processing circuit of claim 19, further including a shaping filter for modifying said audio signal wherein said modified audio signal is in phase with a second audio signal which passes to the eardrum through a passageway and is substantially unaffected by the signal processing circuit and is detectable by said human.

22. The signal processing circuit of claim 19, comprising a hearing aid.

23. The signal processing circuit of claim 19, wherein said gain control circuit further comprises a narrow band filter that passes substantially only the signal tone and wherein the gain amplifying circuit passes only said second frequency range.

24. The signal processing circuit of claim 11, further comprising an acoustical link for passing the injected continuous tone between a receiver and a microphone.

* * * * *